United States Patent [19]

Schroeder

[11] 4,094,014

[45] June 13, 1978

[54] WORKMAN'S GLOVE

[76] Inventor: Charles W. Schroeder, P.O. Box 125, Star Route, Caliente, Calif. 93518

[21] Appl. No.: 736,765

[22] Filed: Oct. 29, 1976

[51] Int. Cl.[2] ..... A41D 27/12

[52] U.S. Cl. ..... 2/161 R

[58] Field of Search ..... 2/16, 20, 159, 160, 2/161 R, 161 A

[56] References Cited

U.S. PATENT DOCUMENTS

| | | | |
|---|---|---|---|
| 1,066,480 | 7/1913 | Finlay | 2/168 |
| 1,279,855 | 9/1918 | Garvey | 2/168 |
| 1,841,193 | 1/1932 | Lidston | 2/16 |
| 2,004,382 | 6/1935 | Palicki | 2/164 |
| 2,735,108 | 2/1956 | Cremer | 2/164 X |
| 3,096,523 | 7/1963 | Bruchas | 2/159 |
| 3,386,104 | 6/1968 | Casey | 2/161 R |
| 3,597,765 | 8/1971 | Stanton | 2/159 |
| 3,600,716 | 8/1971 | Berry | 2/167 |
| 3,606,614 | 9/1971 | Dimitroff | 2/159 |
| 3,643,386 | 2/1972 | Grzyll | 2/161 R |
| 3,882,548 | 5/1975 | Takahashi | 2/161 A |
| 3,916,448 | 11/1975 | Hamel | 2/161 R |
| 3,918,096 | 11/1975 | Lim | 2/161 A |
| 3,997,922 | 12/1976 | Huhta | 2/161 A |

*Primary Examiner*—Doris L. Troutman

*Attorney, Agent, or Firm*—John J. Posta, Jr.

[57] ABSTRACT

The improved glove of the present invention is particularly adapted for protective use by a mechanic or other workman who may encounter sharp and/or heavy solid objects, such as exposed parts of an engine or chassis. The glove includes a protective, hand-enclosing sheath, preferably porous and of rubber, cloth or filamentary mesh. The sheath has a knuckle-protecting surface, a palm-protecting surface and non-slip finger gripping surfaces facing each other, as on the thumb and index finger, to facilitate handling of wrenches and other tools, etc. The non-slip surfaces preferably are added to the sheath and fabricated of corrugated rubber, etc.

The knuckle-protecting surfaces may also be added to the sheath, if the sheath material itself does not afford sufficient protection. In such a case, the knuckle-protecting surface may comprise a transverse portion to protect the knuckles on the back of the hand, and one or more longitudinal portions, preferably connected thereto by thin flexible strips, to protect the finger knuckles. The pads as well as the sheath may be porous to make the glove comfortable to wear. Such glove is inexpensive, durable, fully protective and ideally adapted to provide improved handling of tools.

8 Claims, 5 Drawing Figures

WORKMAN'S GLOVE

BACKGROUND OF THE INVENTION

1. Field of the Invention

The present invention is generally directed to protective means and more particularly to an improved workman's glove featuring protection, convenience, comfort and improved gripping surfaces.

2. Prior Art

A wide variety of protective clothing, gloves, etc. have been fabricated for use by workmen. Most such items, however, have not been well received, either because of the expense, which in many cases is borne by the workman, or because of their poor fit or discomfort in use, or, more importantly, because they impede the activities of the workman, forcing them to be discarded when it is necessary to perform certain tasks.

Thus, protective gloves normally are bulky, uncomfortably warm to wear and difficult to use with tools, such as wrenches, and the like, as by an auto mechanic. Nevertheless, there is a recognized need for convenient, comfortable, easy to use protective gloves which will prevent or reduce hand contusions and will keep the hands reasonably clean in order to minimize the danger of infection in the event of injury to the hands, despite the glove protection.

SUMMARY OF THE INVENTION

The improved glove of the present invention satisfies the foregoing needs. The improved glove of the invention is substantially as set forth in the Abstract above. It combines comfort, proper fit, knuckle and palm protection and finger gripping ability for proper safety, convenience and utility, thus assuring that it will be worn rather than discarded, as with many conventional gloves.

The novel glove of the invention includes a protective sheath of rubber, metal mesh or the like, together with knuckle-protecting surfaces, either added to the back of the sheath or inherent in the nature of the sheath, as in the case when filamentary mesh is used as the sheath. When knuckle protecting pads are added, preferably they cover the knuckles on the back of the hand, as well as the finger knuckles, and such pads may be interconnected to form a single protective surface.

Non-slip pads are added preferably to the palm area of the sheath and definitely to adjoining finger areas of the sheath, preferably to adjoining thumb and index finger areas to permit accurate non-slip handling of tools, such as wrenches and the like. The finished glove is durable and effective for its intended purposes and is relatively inexpensive to make. Further features thereof are set forth in the following detailed description and accompanying drawings.

DRAWINGS

DETAILED DESCRIPTION

FIGS. 1-3

Figure 1:
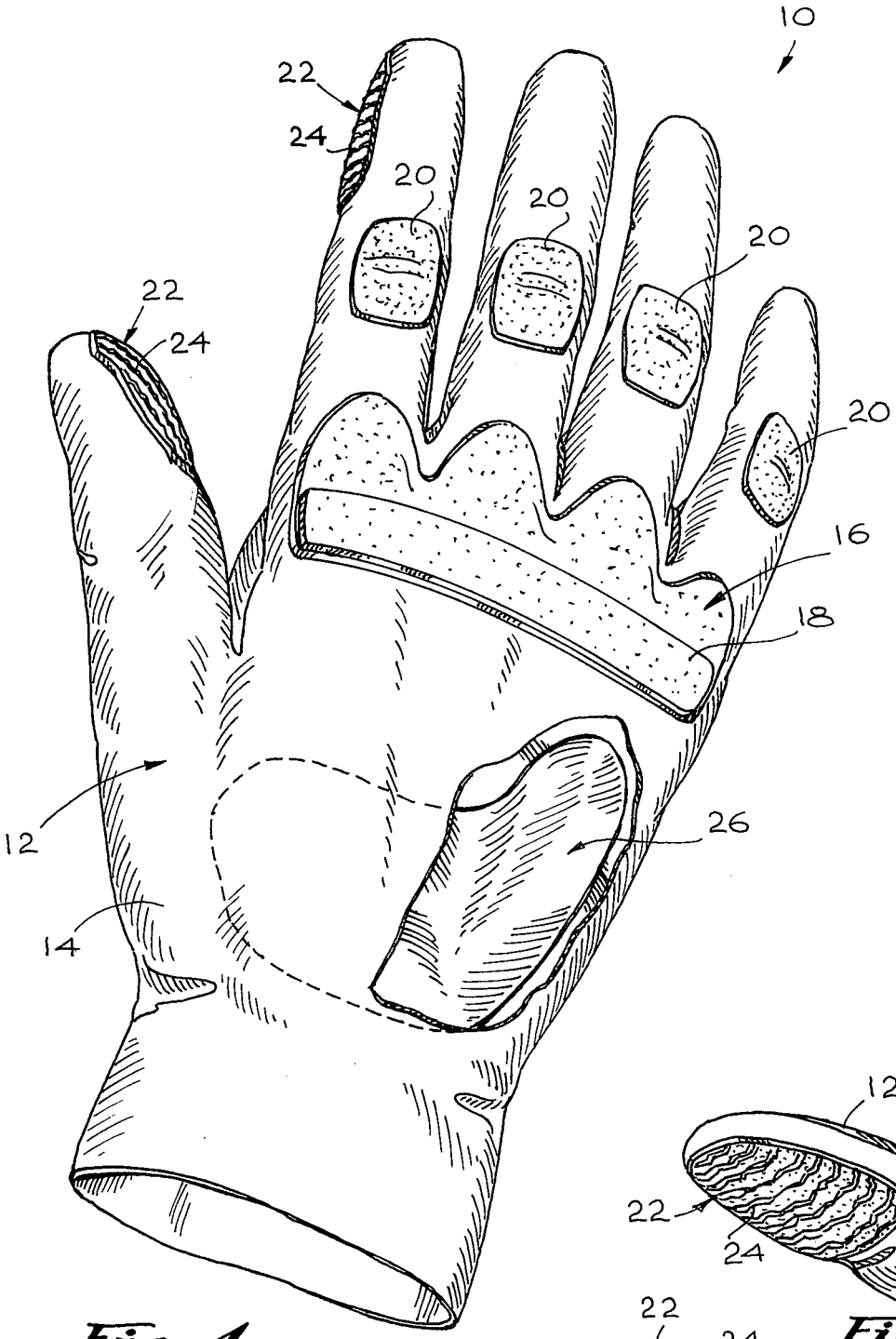
FIG. 1 is a schematic top plan view, partly broken away, of a first preferred embodiment of the improved workman's glove of the present invention.
Figure 2:
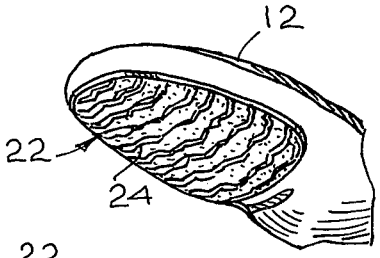
FIG. 2 is a schematic fragmentary bottom plan view of the index finger portion of the glove of FIG. 1.
Figure 3:
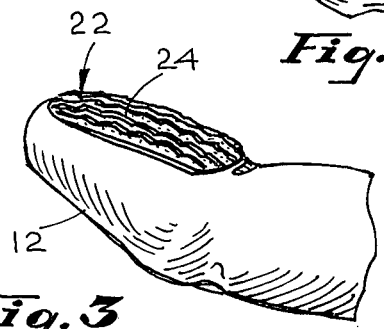
FIG. 3 is a schematic fragmentary bottom plan view of the thumb portion of the glove of FIG. 1.

Now referring more particularly to FIGS. 1-3 of the drawings, a first preferred embodiment of the invention is schematically depicted therein. Thus, as shown in top plan view of FIG. 1, a workman's glove 10, particularly suited for use as a mechanic's glove, is provided, which comprises a flexible sheath 12 of rubber, cloth, rubberized cloth or the like in the form of a hand with fingers and adapted to closely enclose the hand and fingers of a workman.

Sheath 12 is provided on its top rear surface 14 with a plurality of knuckle-protecting cushion pads 16 of flexible cloth, rubber or the like, for example, about 1/16 inch to ⅛ inch thick, adhering to sheath 12 as by glue, stitching or the like. Pads 16 include a transverse pad 18 covering the knuckles on the back of the hand, and pads 20 covering the finger knuckles closest to those covered by pad 18. Pads 16 prevent a hand in glove 10 from inadvertently bruising knuckles against, for example, engine or chassis surfaces during work thereon.

Sheath 12 is also provided with non-slip gripping pads 22 of rubber, cloth or the like, for example, about 1/16 inch thick and glued, sewn or otherwise secured to facing surfaces of the thumb and index finger areas thereof (FIG. 1). Pads 22 partly encircle the thumb and forefinger (FIGS. 2 and 3) and have corrugated surfaces or raised ridges 24 thereon. Surfaces 24 of the thumb of sheath 12 preferably run in a different direction from surfaces 24 of the index finger, thus maximizing the non-slip gripping effect thereof (FIGS. 2 and 3).

Sheath 12 also has a protective cushion palm pad 26, for example, about ⅛ inch thick, formed of flexible rubber, cloth or the like and sewn, glued or otherwide secured to the palm area of sheath 12. Pad 26 permits a tool to be easily held and even struck with the palm of the glove 10 as in moving a wrench or the like, without bruising the palm of the hand while it is in glove 10. Thus, glove 10 provides full protection, utility and convenience of use.

FIG. 4

Figure 4:
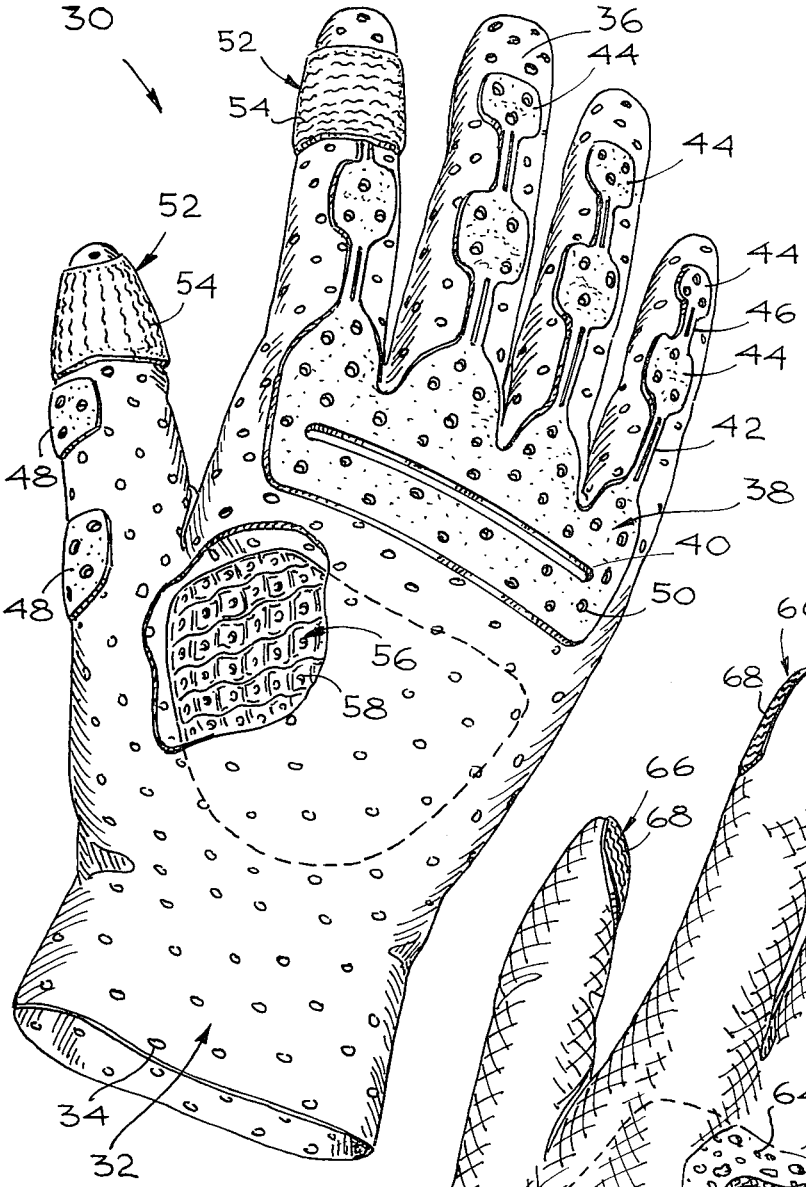
FIG. 4 is a schematic top plan view, partly broken away, of a second preferred embodiment of the improved workman's glove of the present invention.

A second preferred embodiment of the improved glove of the present invention is schematically depicted in FIG. 4. Thus, FIG. 4 shows a glove 30 comprising a hand and finger-enclosing sheath 32 similar to sheath 12 but provided with a plurality of spaced ventilating holes 34 throughout the total surface of sheath 32. Sheath 32 has on the back 36 thereof a single large knuckle-protecting pad 38 comprising a transverse portion 40 connected by thin flexible strips 42 to a series of spaced finger knuckle pads 44, interconnected in each finger area by thin flexible strips 46.

Separate protective pads 48 cover the knuckles of the thumb area of sheath 32. Each pad 38, 44, and 48 has ventilating holes 50 therethrough and is of flexible rubber, cloth or other padding, about ⅛ inch thick and secured to sheath 32, as by glue, stitching, etc.

Finger-gripping pads 52 encircle adjoining thumb and index finger areas of sheath 32 and are provided with corrugated non-slip surfaces 54. Pads 52 may, for example, be of about ⅛ inch thick stretch rubber or the like and are removable and repositionable, if desired, relative to sheath 32. Thus, pads 52 can be replaced by similar pads (not shown) having corrugated surfaces (not shown) or preselected specialized form for different applications.

A palm pad 56 of, for example, ⅛ inch thick flexible rubber, cloth, etc. is secured to the palm area of sheath 32 and extends outwardly thereof to provide an exposed non-slip corrugated surface 58, as shown in FIG. 4, in order to aid in gripping and handling tools. Thus, glove 30 is cool, comfortable, convenient and adaptable to use for maximum results.

FIG. 5

Figure 5:
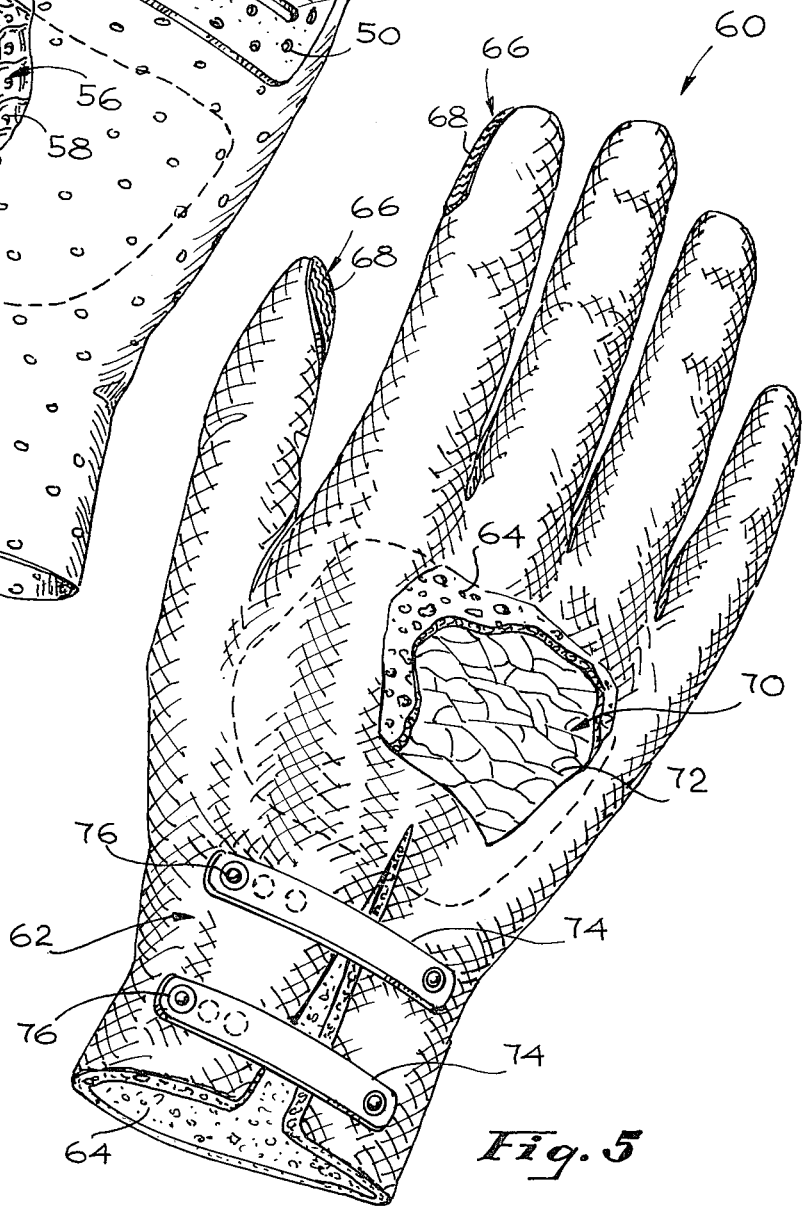
FIG. 5 is a schematic top plan view of a third preferred embodiment of the improved workman's glove of the present invention.

A third preferred embodiment of the invention is schematically depicted in FIG. 5. Thus, shown in top plan view in FIG. 5 is a glove 60 comprising a sheath 62 of woven open mesh filament, such as fiberglass, nylon or polytetrafluosethylene or the like or very thin metal, such as aluminum wire, copper wire, brass wire, thin galvanized steel wire or the like sufficiently resilient so as to be able to conform to the shape of a hand and to permit movement of the fingers. It is preferred to use non-metallic filaments rather than the metal for such purposes. In any event, sheath 62 may be provided with a soft porous lining of perforated sponge rubber or the like to protect the worker's hand against abrasion from sheath 62.

The nature of sheath 62 is such as to effectively provide knuckle protection without necessitating the use of separate pads, etc. However, separately applied gripping pads 66 on facing surfaces of the thumb and index finger areas of sheath 62, as shown in FIG. 5, are needed to provide the necessary non-slip tool-handling grip. Pads 66 are similar in construction to pads 22 and include corrugated gripping surfaces 68 generally similar to surfaces 24.

Sheath 62 has secured thereto in the palm area as by gluing, etc., a large palm pad 70 having an irregular gripping surface 72 fabricated of cloth, rubber or the like, and preferably 150 inch or more in thickness. Pad 70 enables a better than usual grip to be maintained on a tool or workpiece and permits striking thereof, for example, to turn a wrench on a bolt, without bruising of the mechanic's palm.

A pair of adjustable straps 74 releasably secured to selected studs 76 on the back of sheath 62 facilitate holding of glove 60 on the workman's hand and adjusting it for a perfect fit.

Thus, glove 60 as in the case of gloves 10 and 30, provides those advantages over the art which encourage its use as a protective medium. Various other advantages are set forth in the foregoing.

It will be understood that various changes, modifications, alterations and additions can be made in the glove of the present invention and in its components and their parameters. All such changes, modifications, alterations and additions as are within the scope of the appended claims form part of the present invention.

What is claimed is:

1. An improved workman's glove, said glove comprising, in combination:

a. a protective sheath in the shape of a hand with fingers and adapted to cover the hand of a workman, including the fingers thereof;

b. a first knuckle-protecting pad of extended surface area secured to the outside surface of said sheath and adapted to overlie the knuckles on the back of the hand and be configured with respect thereto;

c. a plurality of finger knuckle protecting pads of extended surface area secured to the outer surface of said sheath and adapted to overlie the finger knuckles and be configured with respect thereto;

d. non-slip gripping pads located on and secured to the inside of the thumb and index finger areas of said sheath; and, e. a protective palm pad of extended surface area secured to substantially all of the palm area of said sheath, and covering substantially all of the lower part of said palm area.

2. The improved glove of claim 1 wherein said non-slip pads encircle at least a portion of the thumb and index finger areas on the outside of said sheath and wherein said glove is a mechanic's glove.

3. The improved glove of claim 2 wherein said non-slip pads are removable from said sheath and include surface corrugations, and wherein said corrugations of said thumb pad are oriented differently from those of said index finger pad to facilitate gripping.

4. The improved glove of claim 1 wherein said knuckle pad includes a transverse portion to protect the knuckles on the back of the hand, and longitudinal portions to protect the finger knuckles.

5. The improved glove of claim 4 wherein said transverse and longitudinal portions are interconnected by thin flexible strips.

6. The improved glove of claim 1 wherein said sheath comprises an open mesh of scuff-resistant flexible protective material.

7. The improved glove of claim 1 wherein said sheath comprises non-metallic filamentary mesh.

8. The improved glove of claim 6 wherein said sheath is lined with soft porous material to protect the hand against said mesh.

* * * * *